US009957081B2

(12) United States Patent
Gayer

(10) Patent No.: US 9,957,081 B2
(45) Date of Patent: May 1, 2018

(54) MULTI-PORTION REMOVABLE COVER APPARATUS AND RELATED METHODS

(71) Applicant: Mark Gayer, Rose Hills, KS (US)

(72) Inventor: Mark Gayer, Rose Hills, KS (US)

( * ) Notice: Subject to any disclaimer, the term of this patent is extended or adjusted under 35 U.S.C. 154(b) by 0 days. days.

(21) Appl. No.: 14/414,076

(22) PCT Filed: Jul. 11, 2013

(86) PCT No.: PCT/US2013/050162

§ 371 (c)(1),
(2) Date: Jan. 9, 2015

(87) PCT Pub. No.: WO2014/011938

PCT Pub. Date: Jan. 16, 2014

(65) Prior Publication Data

US 2015/0203245 A1 Jul. 23, 2015

Related U.S. Application Data

(60) Provisional application No. 61/670,433, filed on Jul. 11, 2012.

(51) Int. Cl.
*B65D 77/20* (2006.01)
*B65D 17/00* (2006.01)
(Continued)

(52) U.S. Cl.
CPC ..... *B65D 17/163* (2013.01); *B65B 7/2842* (2013.01); *B65B 51/02* (2013.01); *B65B 61/18* (2013.01); *B65D 5/708* (2013.01); *B65D 77/2032* (2013.01); *A63F 2003/00955* (2013.01); *A63F 2003/00965* (2013.01); *B65D 2517/0013* (2013.01); *B65D 2577/205* (2013.01); *B65D 2577/2091* (2013.01)

(58) Field of Classification Search
CPC .. B65D 17/163; B65D 5/708; B65D 77/2032; B65D 2715/0013; B65D 257/205; B65D 257/20917; B65B 51/02; B65B 61/18; B65B 7/2842
USPC ..... 229/123.2, 125.35, 164.1, 254, 924; 220/276, 359.2
See application file for complete search history.

(56) References Cited

U.S. PATENT DOCUMENTS 3,701,454 A * 10/1972 Thorp ..... B65D 17/165 220/270
4,209,126 A * 6/1980 Elias ..... B65D 51/20 215/232
5,002,223 A * 3/1991 Bolte ..... B65D 77/2044 220/276

FOREIGN PATENT DOCUMENTS

DE 3842523 A1 6/1990
DE 102005026903 * 8/2006 ..... B65D 75/00
(Continued)

*Primary Examiner* — J. Gregory Pickett
*Assistant Examiner* — Elizabeth Volz
(74) *Attorney, Agent, or Firm* — J. Mark Holland + Assoc; J. Mark Holland; Alison L. Adnan

(57) ABSTRACT

Apparatus and methods are disclosed for sealing openings on containers and other structures, permitting selective removal of portions of the seal structure, and for similar selective removal of portions of adhesive elements such as bandages. A seal layer is sized and configured to cover an opening. The seal layer has at least one tear line, where the tear line is positioned and formed for tearing the seal layer for selective removal of a portion of the seal layer from the opening. A tab is connected to the seal layer providing a gripping portion for the user.

4 Claims, 17 Drawing Sheets

(51) Int. Cl.

| | |
|---|---|
| ***B65B 7/28*** | (2006.01) |
| ***B65B 61/18*** | (2006.01) |
| ***B65D 5/70*** | (2006.01) |
| ***B65B 51/02*** | (2006.01) |
| *A63F 3/00* | (2006.01) |

(56) References Cited

FOREIGN PATENT DOCUMENTS

| | | | |
|---|---|---|---|
| DE | 102005026903 | A1 | 8/2006 |
| EP | 1361173 | A1 | 11/2003 |
| EP | 1481904 | A1 | 12/2004 |
| WO | 2007088436 | A1 | 12/2007 |

* cited by examiner

Fig. 1H
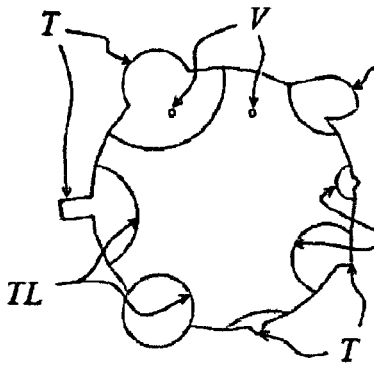
Fig. 1I
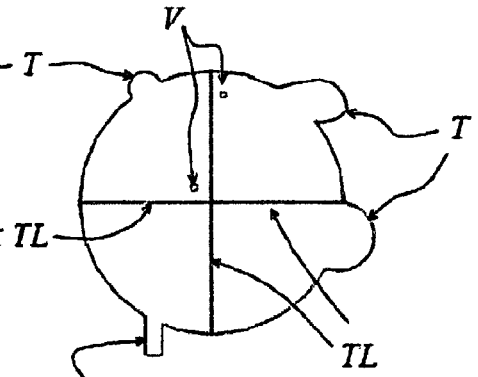
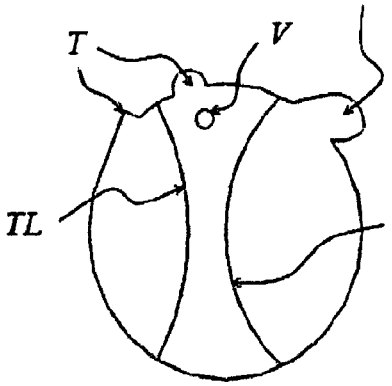
Fig. 1J
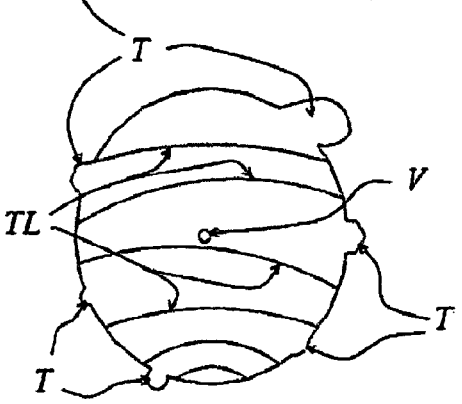
Fig. 1K
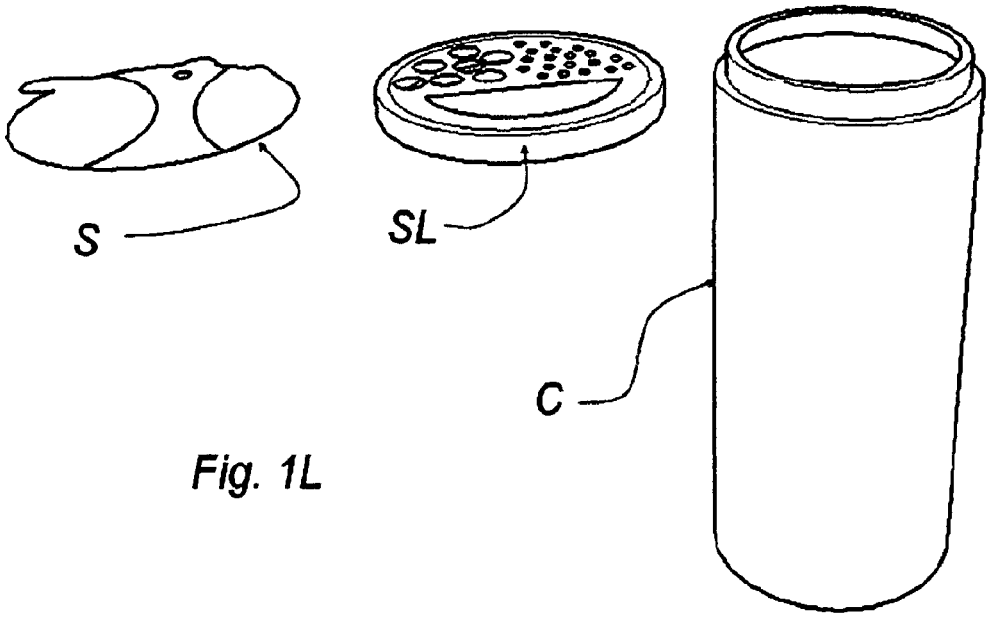
Fig. 1L

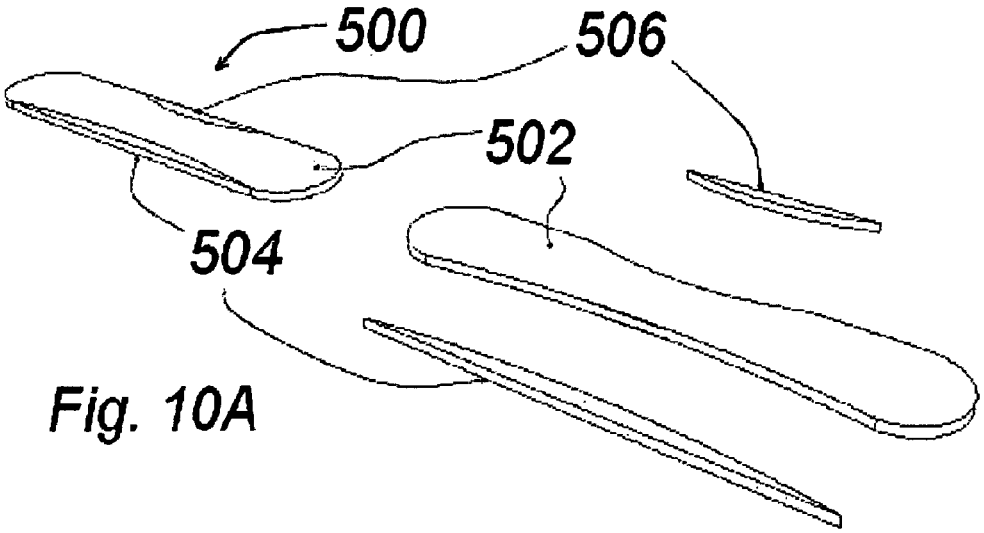
Fig. 10A
Fig. 10B
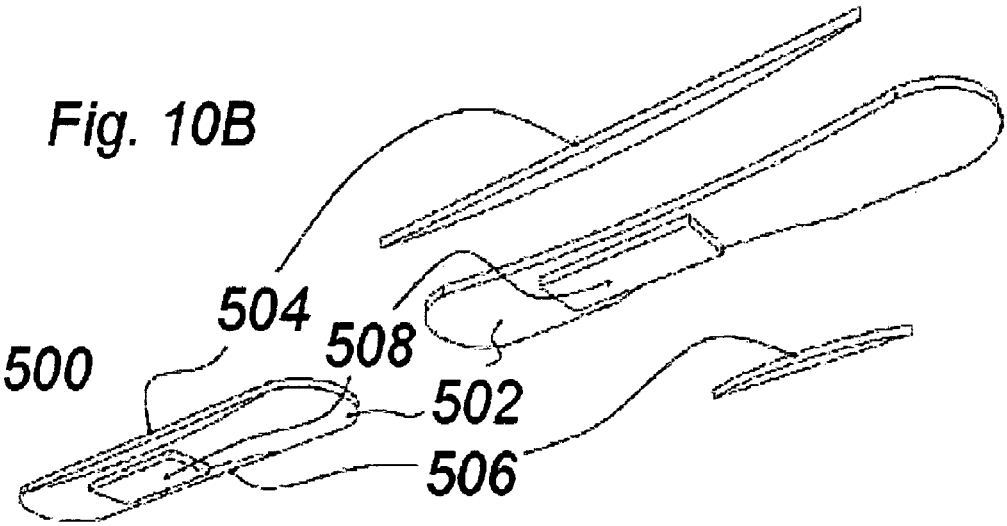

MULTI-PORTION REMOVABLE COVER APPARATUS AND RELATED METHODS

CROSS-REFERENCE TO RELATED APPLICATIONS

This application claims priority to U.S. Provisional Application Ser. No. 61/670,433, filed Jul. 11, 2012, the disclosure of which is incorporated herein by reference in its entirety.

FIELD OF THE INVENTION

The present invention is directed to closures and covers and similar apparatus, and to methods of using same.

The present invention is described herein with reference to the accompanying Figures, which serve as illustrations of some of the many embodiments in which the invention may be practiced. Subject to the context and other factors (including for example the understanding of persons of ordinary skill in the arts relevant to the inventions), generally in those Figures and references similar reference numerals refer to similar or identical elements throughout this description.

Those Figures and references, and the other terminology used in these descriptions, are not intended to be interpreted in any limited or restrictive manner, simply because it is being utilized in conjunction with a detailed description of certain embodiments of the invention. Furthermore, various embodiments of the invention (whether or not specifically described herein) may include one or more of the novel features disclosed herein, no single one of which (a) is necessarily solely responsible for any particular desirable attribute(s) of the inventions or (b) is essential to practicing the inventions described.

Although the disclosed inventions may provide many benefits and be useful in a broad range of applications, they are particularly useful in apparatus and methods in which it is desirable to uncover and/or unseal a selected portion of an opening, a passageway, a diagram or other indicia, and the like. Among the many embodiments of the invention are seals on containers, permitting the user to effectively "open" all and/or a portion of the container's openings by removing all or a selected part of the seal. Other examples of embodiments include compartmentalized containers such as kitting boxes or the like, educational and/or entertainment games and devices, in which (among many other things) a user uncovers an answer or clue or opening (or a portion of any of those) by selectively removing a portion of a covering layer.

BRIEF DESCRIPTION OF THE DRAWINGS

FIGS. 1H-1K are top views of some of the many generally circular embodiments of the invention.

FIGS. 10A-10D illustrate still another application of the invention on an adhesive bandage.

DETAILED DESCRIPTION OF EMBODIMENTS

Figure 1A:
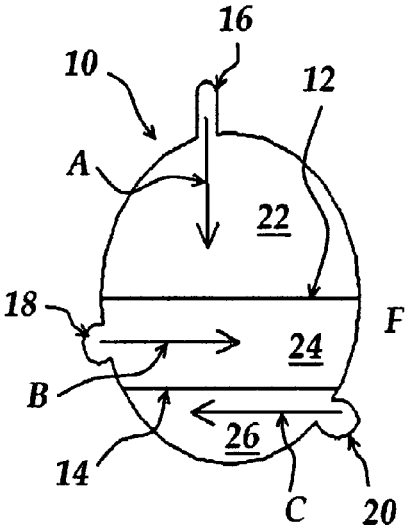
FIG. 1A is a top view of one of the many generally circular embodiments of the invention.

As indicated above, the inventions disclosed herein can be used in a broad range of applications and provide many benefits. In one embodiment, a generally circular seal or cover layer 10 preferably is provided with tear lines 12 and 14. The seal/cover 10 can be adhered at its edges to a container opening (such as one of the containers shown in other of the attached Figures, such as the series in FIGS. 2 and 3), to provide a spillage barrier and/or even an airtight or hermetic seal of the contents of the container.

The seal/cover 10 may be fabricated from any suitable material and by any suitable process. For many applications, the material can be paper (plain, or treated with wax or similar substance), plastic, aluminum foil, or some other material that provides the desired seal or cover properties of the element 10. Embodiments can be made by combining selected materials, in layers or otherwise, and the thickness of each layer and/or the composite seal/cover can be any suitable thickness. Any or all of the layers may be opaque, transparent, and/or any degree in between those two.

The cover 10 preferably includes one or more tear lines such as lines 12 and 14, formed as thinned or scored areas of the cover, as partially perforated lines, as pre-folded lines, or in any other suitable manner to facilitate the subsequent tearing of the cover along the relevant line. The lines 12 and 14 effectively divide the seal/cover 10 into a desired plurality of regions such as regions 22, 24, and 26. Also preferably, each region is removable from the original cover 10 (although not all regions need be). Removable regions preferably have a pull-tab such as 16, 18, and 20 to facilitate selection and/or removal of a desired region 22, 24, and/or 26. Arrows A, B, and C indicate a preferred tearing direction, and those arrows A, B, and C (along with other useful information, advertising, or the like, if desired) can even be embossed, painted, or otherwise imprinted onto the seal 10 (along with the word "TEAR", not shown). The tabs 16, 18, and/or 20 can be any suitable size, location, thickness and other characteristics that provide the desired aesthetics and utility for the cover 10.

The tear lines 12 and 14 can be in any convenient or desired pattern, shape, curvature, and size. Just a few of the many alternatives are shown in FIGS. 1A through 1L. For example, the embodiment illustrated in FIG. 1B is similar to that of FIG. 1A, but the tearlines D, E, and F are positioned to divide the cover 30's circle into approximately equal portions. The tabs 32, 34, and 36 can be positioned and shaped to fine-tune the removal operation of each section of the cover 30. Dashed line 38 indicates the inside diameter of the container spout opening (not shown) onto which the cover 30 may be affixed. Adhesive or other sealant can be applied or provided between the container (such as at the lip of the opening being covered by seal 30) and the outer portion of the cover 30 (such as indicated by the ring between line 38 and the outer perimeter of the cover 30). Preferably, the tabs 32, 34, and 36 do not have any adhesive underlying them, so that they may be more readily grasped by a user for the removal action. One or more ventilation holes 39 can be provided to accommodate changes in atmospheric pressure that may occur between the sealing of the container and the removal of one or more portions of the seal 30.

Among the examples of more complex, multi-layered embodiments, a thin film of plastic can be provided across the entire container opening and removably sealed to the container around the entire circumference of the opening, and a second (perhaps tougher) layer of material having tear lines formed in it and having protruding tabs (such as those described above) can be glued, melted, or otherwise operatively affixed in an overlying relationship on top of the thin plastic film layer (although the order of the layers could be reversed if desired). In such embodiments, the thin plastic film layer can serve as an hermetic seal (with no score lines or perforations in it), and the thicker layer bonded to it can provide the desired function of providing selectable removal of portions of the cover. For example, the adhesive between the layers, and the tearability of the materials, can be such that even though the thin layer is not scored (so it will provide a more reliable seal), the thin tears at least generally along the same line as the scored thicker layer when a user removes a selected section of the cover.

Figure 1B:
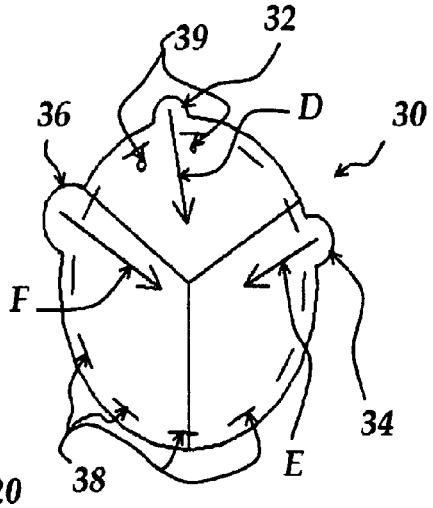
FIG. 1B is a top view of another of the many generally circular embodiments of the invention.
Figure 1C:
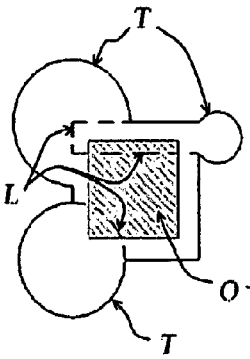
FIGS. 1C-1G are top views of some of the many other embodiments of the invention.
Figure 1D:
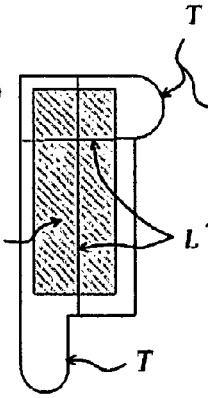
Figure 1E:
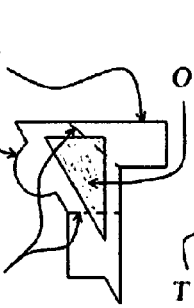
Figure 1F:
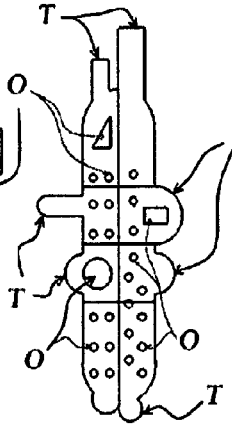
Figure 1G:
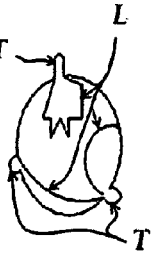

When covers similar to that shown in the embodiment of FIG. 1A are used to seal a round opening on containers of liquid or granular material, for example (e.g., motor oil, cooking oil, spices, laundry soap, pet food, baby powder, industrial chemicals, etc.), the user preferably can select a variety of "openings" for the container. By grasping tab 20 and pulling along the direction of line C to remove section 26, the user can tear the seal 10 along line 14 and thereby "open" approximately ¼ of the container's dispensing spout opening (container examples are illustrated in other of the accompanying Figures). Similarly, using tab 18 to pull along line B enables the user to separate or tear the cover 10 along both lines 12 and 14 and remove section 24, and using tab 16 to pull along line A enables the user to remove section 22. Removing all three sections 22, 24, and 26 results in the "complete" opening of the container's dispensing spout, the combination of sections 22 and 24 results in approximately 75% of the cover being removed, and 50% can be achieved by either removing just region 22, or by removing both regions 24 and 26.

In Figures FIGS. 1C-1F, the letter "O" denotes an example of the opening(s) that could be covered by the seal, the letter "T" denotes a tab portion(s) that can be provided to facilitate removal of the seal and/or selected portions thereof, and the letter "L" identifies exemplary "tear lines" or score lines that may be provided to facilitate a desired removal of a portion of the seal. FIGS. 1G-1K illustrate some of the many generally circular embodiments of the invention having a variety of arrangements of removable seal portions. In those figures, "T" indicates a tab element, "TL" indicates a tearline, and "V" indicates a vent hole.

Figures 1, 1L:
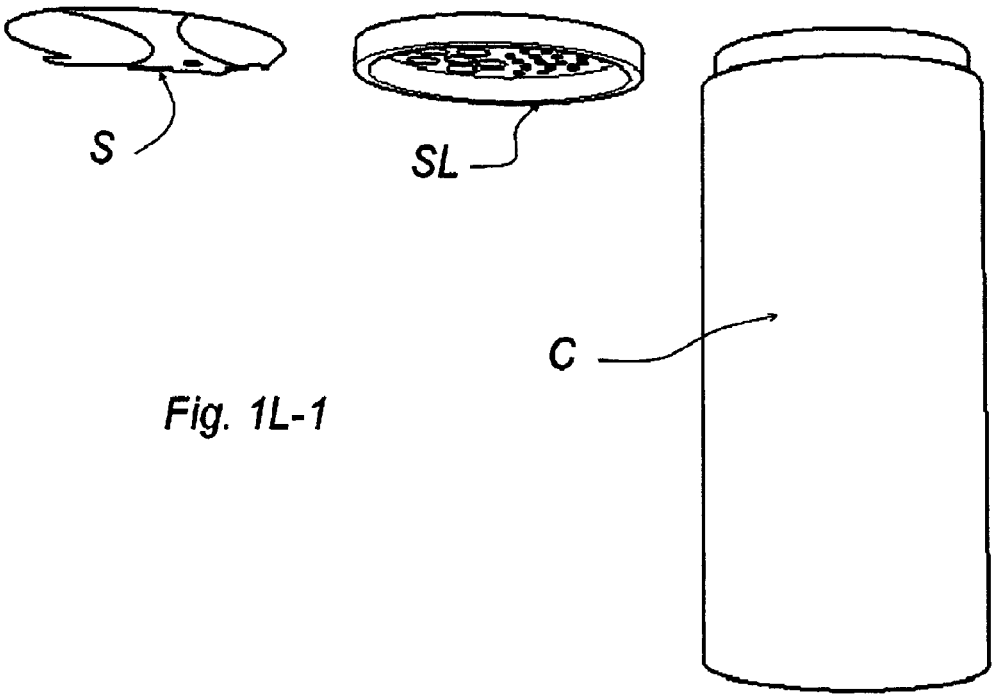
FIGS. 1L and 1L-1 through 1L-4 are isometric, side, and top views showing the assembly of a seal element with a container and container lid.
Figures 1, 1L, 2:
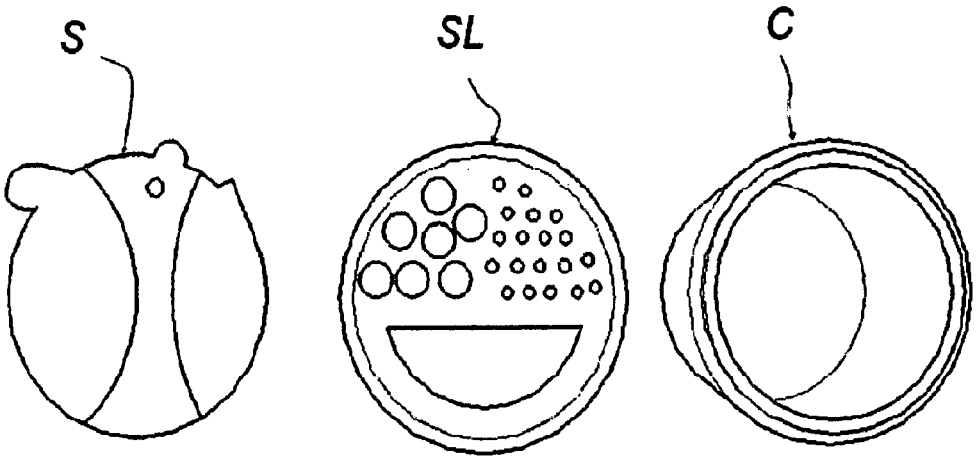
Figures 1, 1L, 2, 3, 4:
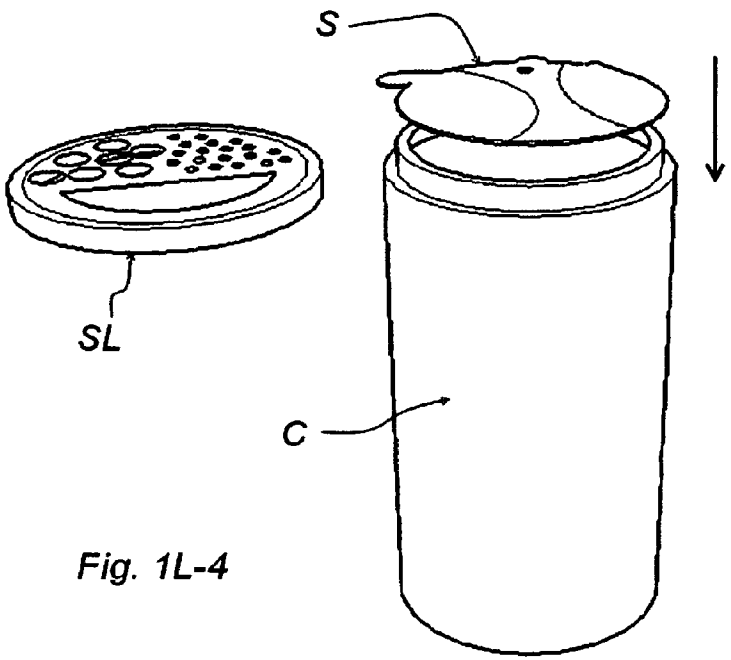
Figures 1, 1L, 2, 3:
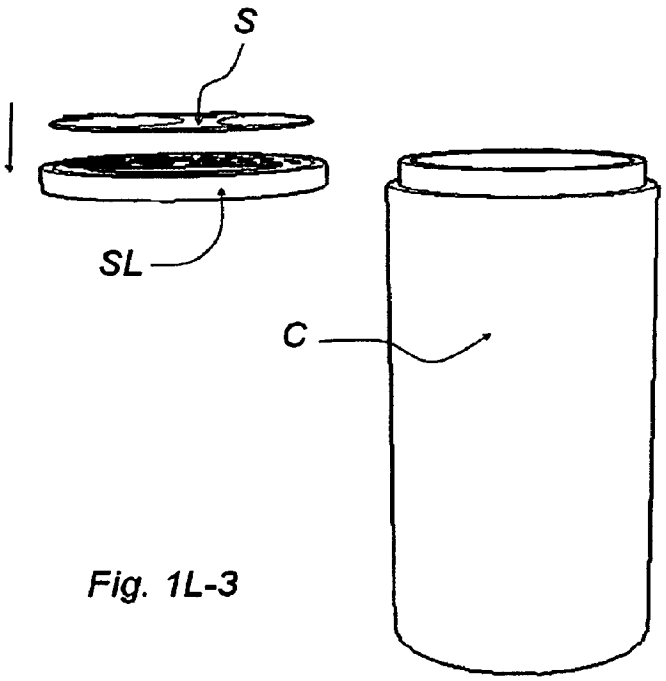

FIGS. 1L-1L(4) show the assembly of a preferred circular seal element "S" with a container "C" (for example, a container for baby powder, herbs, salt, etc. —anything you might want to shake or spoon out from the container), wherein "L" indicates a shaker lid associated with the container. At least two ways to assemble the seal element with the container and lid are shown: 1. sealed across the top of the container (i.e., INSIDE the container), with the shaker lid then snapped over it (FIG. 1L-4). In this case, the user has to remove the lid, tear off some/all of the seal, then put the lid back onto the top of the container; 2. sealed across the top of the lid (i.e., OUTSIDE the container) (FIG. 1L-3). In this case, the user just has to remove some/all of the seal. In either case, the hole pattern in the lid can be any of a wide variety, including having a hinged/closable flap portion (not shown) covering one or more of the openings such as the half-moon shaped opening.

Figure 2A:
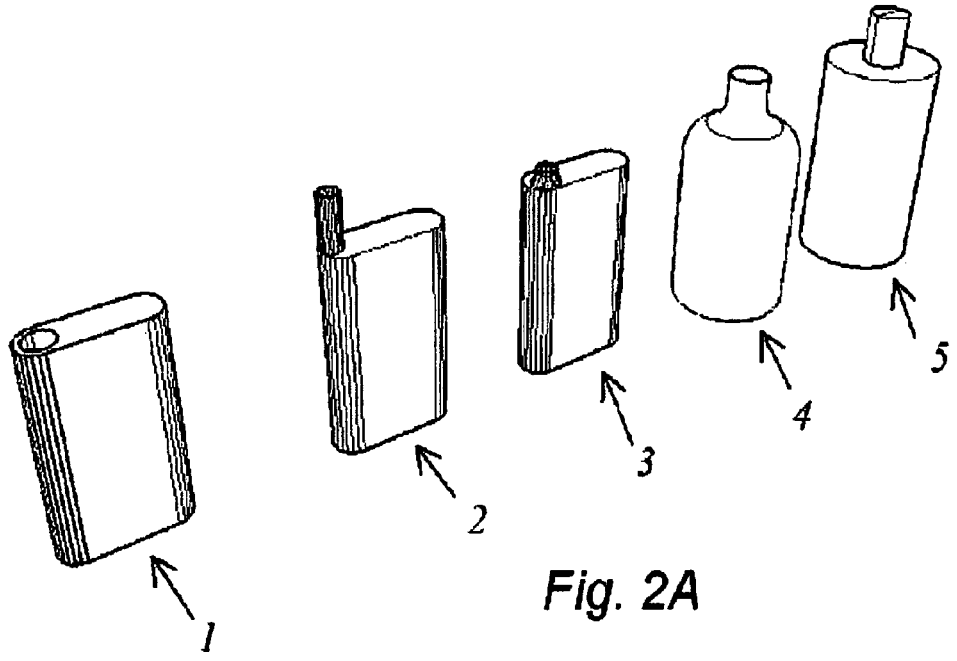
FIGS. 2A-2I illustrate some of the virtually unlimited range of containers and openings with which the cover 10 can be used.
Figure 2B:
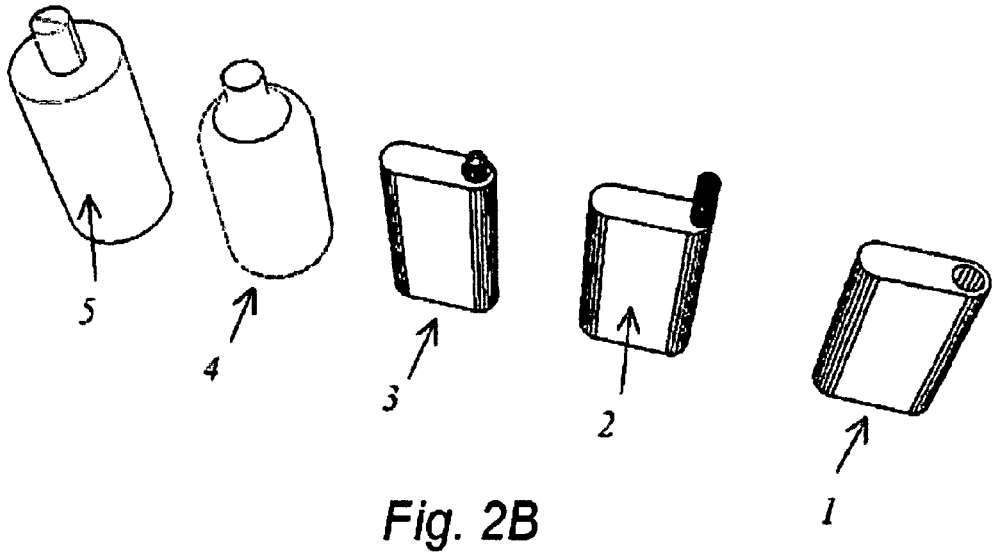
Figure 2C:
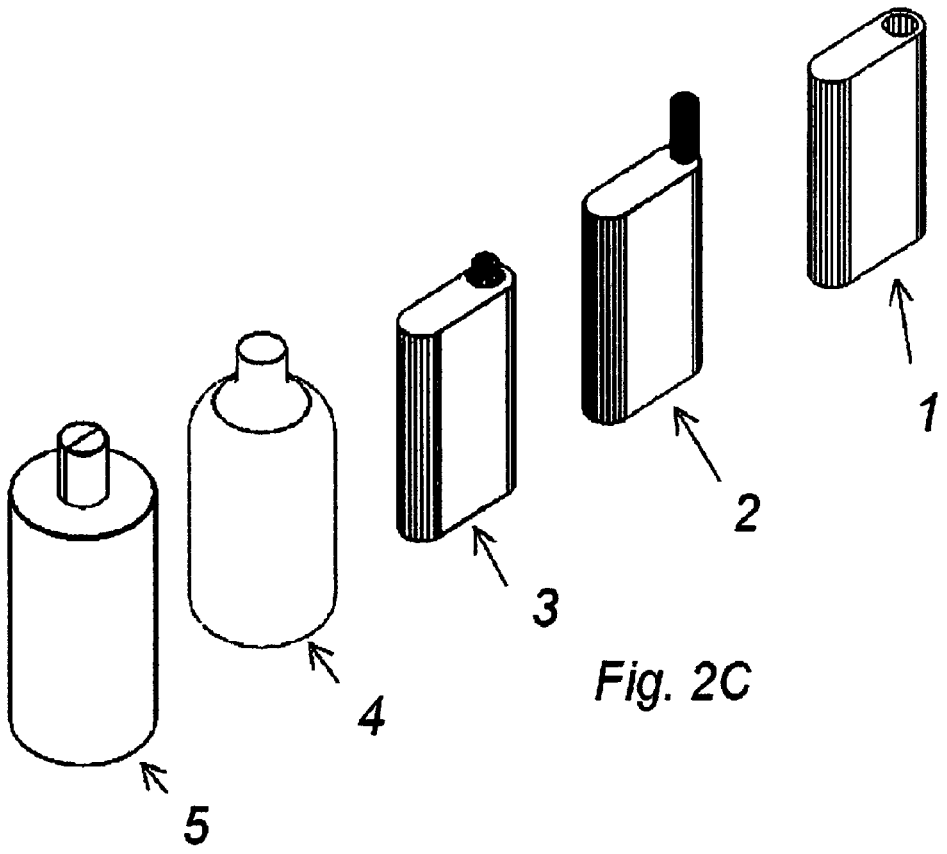
Figure 2D:
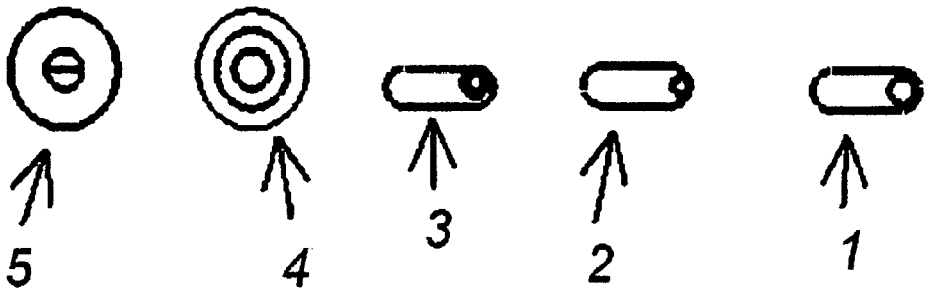
Figure 2E:
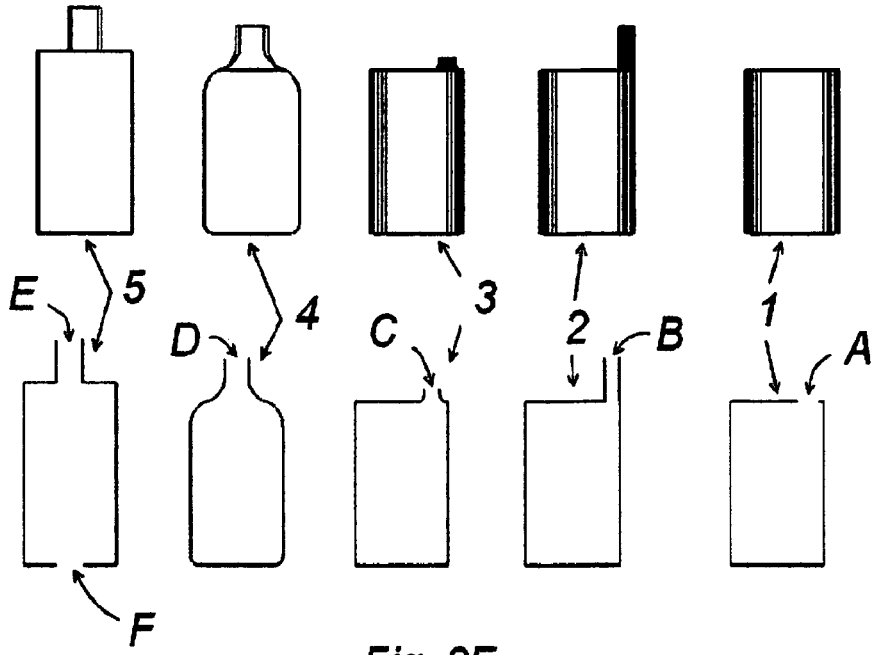
Figure 2F:
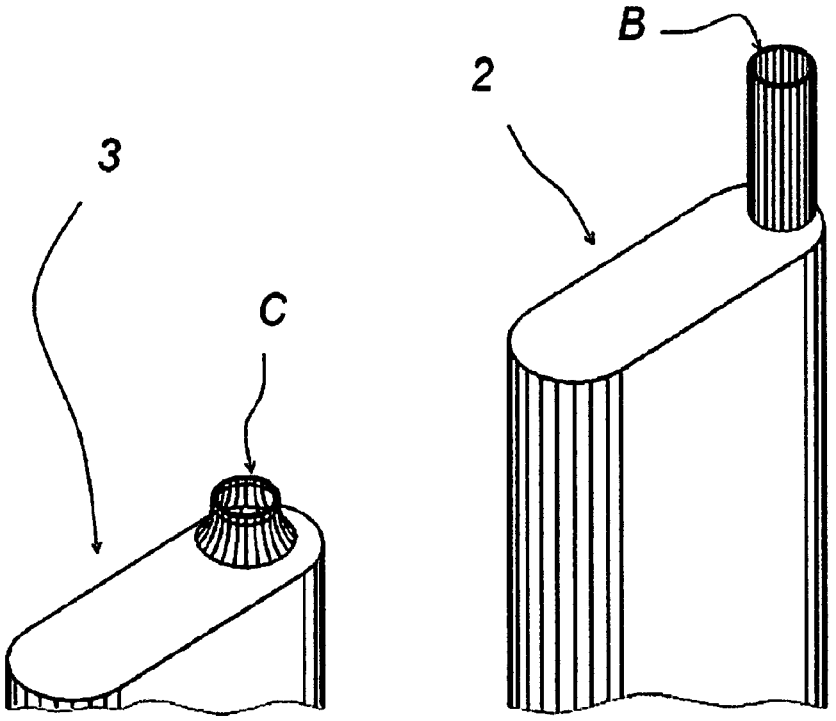
Figure 2I:
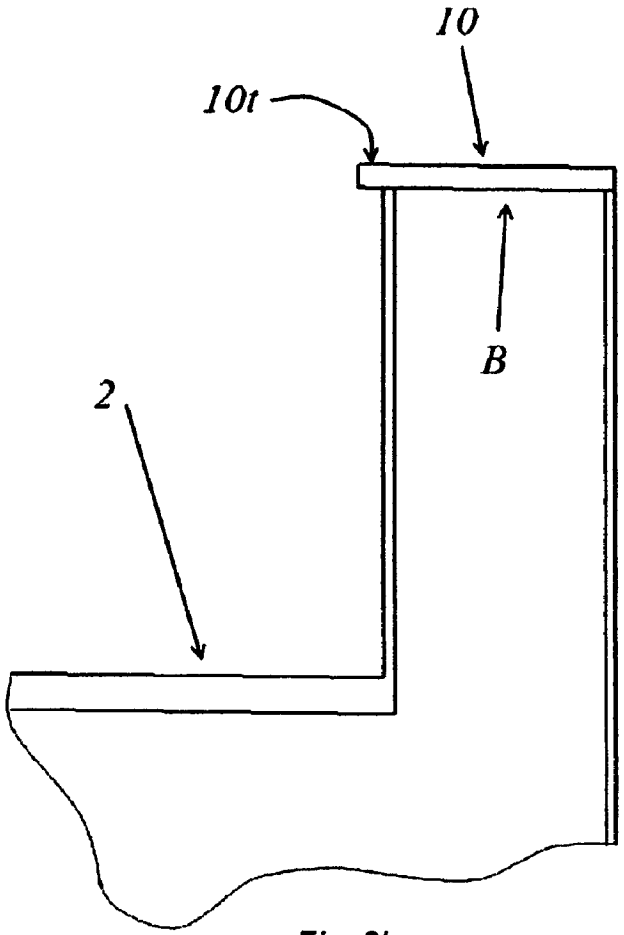
Figure 2G:
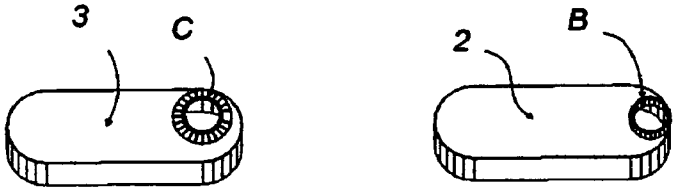

Examples of the virtually unlimited range of containers and openings with which the cover 10 can be used are illustrated in FIGS. 2A-I and 3A-F. The containers in the FIG. 2A-I sequence are some of the many generally circular/oval embodiments with which the invention may be practiced. FIGS. 2A, 2B, and 2C are various perspective views of a series of five exemplary round/oval containers. FIG. 2D is a top view of that same series. Persons of ordinary skill in the art will understand that, although several of the containers shown include spouts with generally round necks, the shape of any such neck and/or the related opening, as well as the dimensions and even the existence of such a neck (see container #1 in the FIG. 2 series, which has "no" neck extending upwardly) can vary according to the application and the desired function of the embodiment. Among other things, the lower row of FIG. 2E illustrates sectional views of the respective containers 1-5, and exemplary openings A-F that may be provided in same and may be covered by a seal of the invention. Among other things, FIG. 2F is a foreshortened isometric view of the containers 2 and 3 from the FIG. 2 series. FIG. 2G is almost a top view of those same containers 2 and 3 from the FIG. 2 series, with the view slightly angled so that the lowest horizontal lines indicate the bottom edge of the containers. Although not shown in the drawings, "wide mouth" containers/cans and packets of varying shapes and sizes may also be used with the present invention.

Figure 2H:
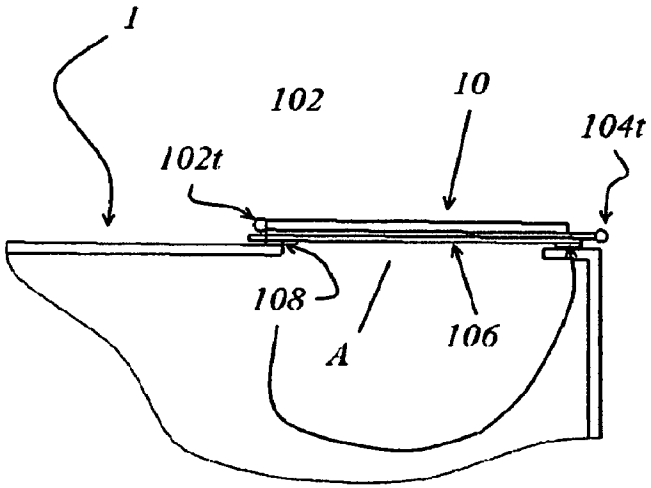

Persons of ordinary skill in the art will understand that one or more seals such as shown in FIG. 1A and/or 1B may be placed in a sealing relationship over the openings A-F (see FIG. 2E) to permit controlled containment of a solid, liquid, or gas within the container. One of the many embodiments of the seal aspect of the invention as assembled on a container is example is illustrated in FIG. 2H, which is a foreshortened sectional view of the opening A of the container #1 of the FIG. 2 series. Adhesive means 108 is positioned generally around the opening A, and one or more seal layers such as layers 102, 104, and/or 106 are positioned across some or all of the opening A. Tabs 102*t*, 104*t*, and 106*t* each are provided on their respective layer to facilitate removal of some or all of the attached layer, and can correspond (at least conceptually) to the tabs 16, 18, and 20 in FIG. 1A, and/or to tabs 32, 34, and 36 in FIG. 1B. Another example is illustrated in FIG. 2I, which is a foreshortened sectional view of the spout area of the container #2 of the FIG. 2 series. The opening B is covered by a single-layered embodiment 10 preferably having a tab 10*t* (again, persons of ordinary skill in the art will understand that the invention may be practiced without the inclusion of any removal tabs, and/or may include having multiple tabs on a single section of the seal member 10. The view of FIG. 2I illustrates only one such tab, but the seal 10 preferably is formed with a plurality of sections that can be removed separately from each other, to control the degree to which the opening B is "opened".

Figure 3A:
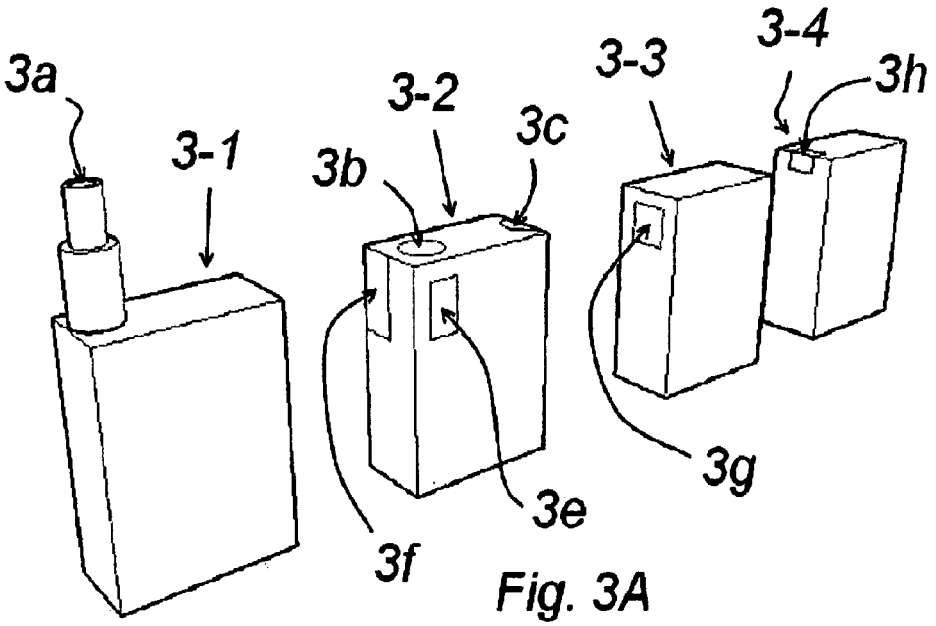
FIGS. 3A and 3B are similar to the FIG. 2 series, but illustrate a variety of generally rectangular containers with which the invention may be practiced.
Figure 3B:
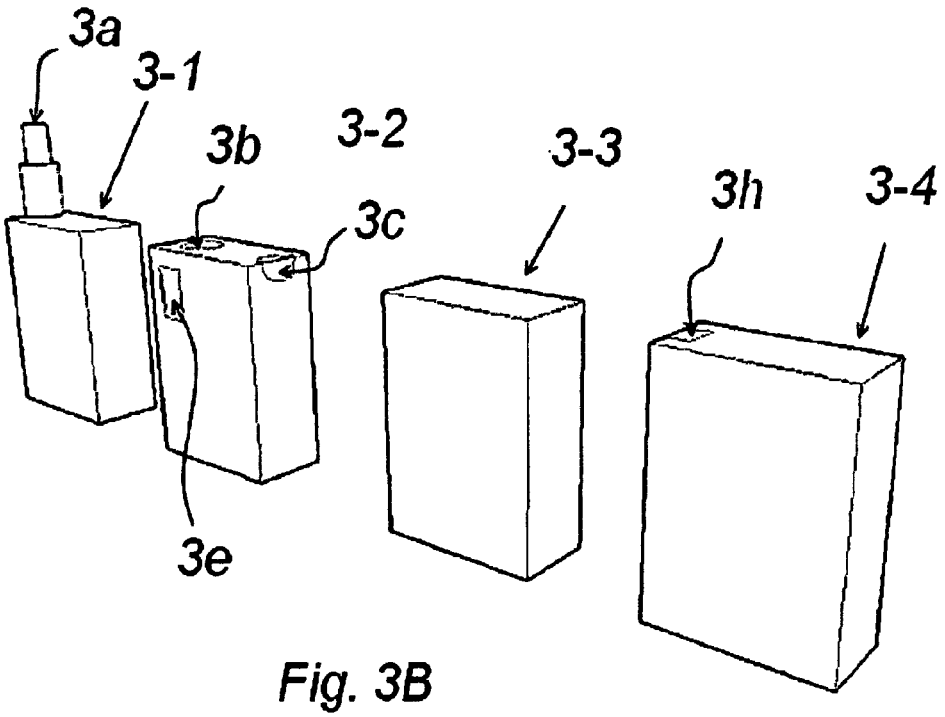

Among other things, the generally rectangular container embodiments illustrated in FIGS. 3A and 3B (containers 3-1, 3-2, 3-3, and 3-4) show how openings may be provided in the containers at any one or more convenient locations, such as those shown as openings 3*a*-3*h*. A segmented seal of the invention can be shaped and oriented and affixed in a covering relationship over one or more of such openings, to be selectively removed by a user. Persons of ordinary skill in the art will understand that such "multiple" openings may be used and provided for virtually any shape or size of container, and that the specific and relative size and location of such opening(s) on the container can be designed and selected based on a wide range of criteria, such as to provide ease of pouring, ease of access to the interior, a variable-sized "breathing hole/vent" away from the main spout through which liquid or other material is to be poured, etc.

Figure 4B:
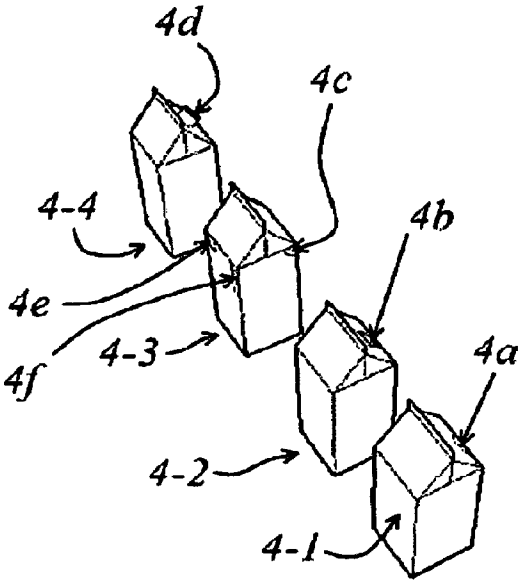
FIGS. 4A and 4B likewise illustrate embodiments that are generally shaped like a milk or juice carton, with exemplary openings 4*a*-4*d* that may be covered with one or more seals of the invention.
Figure 4A:
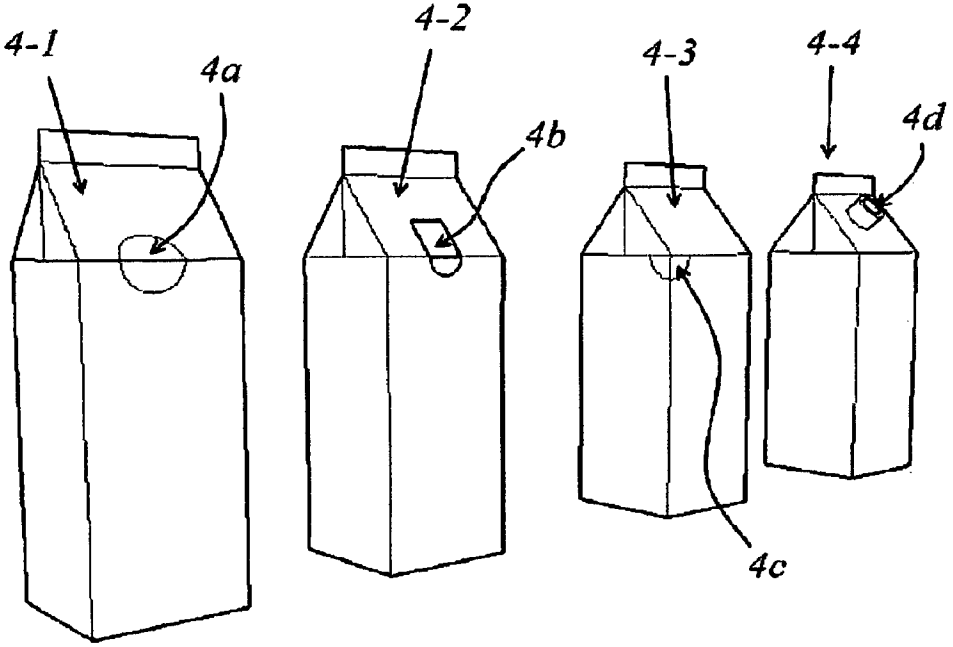

In FIGS. 4A and 4B, similar concepts are illustrated for milk or juice carton-shaped containers 4-1, 4-2, 4-3, and 4-4. Among other things, persons of ordinary skill in the art will understand that opening 4*d* (like opening 3*a* in FIGS. 3A and 3B) is associated with a spout structure, such as those commonly in use on juice and milk cartons. Embodiments may include separate covers or caps (snap-on, screw-on, or otherwise) (not shown in the drawings) that can be replaced over the spout to completely close the spout's opening (3*a* or 4*d* or the like).

Figure 5B:
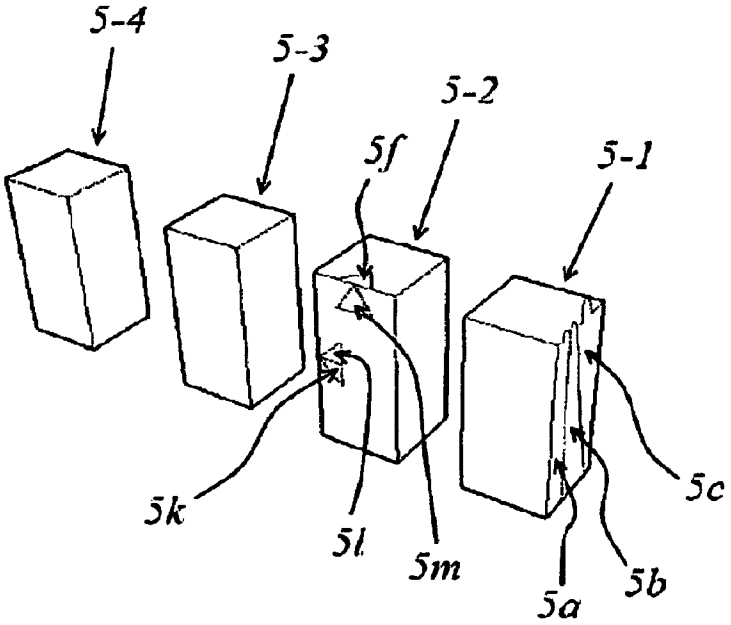
FIGS. 5A and 5B are similar, but illustrate embodiments shaped similarly to a box of facial tissues, with a plurality of openings 5*d*-5*j*.
Figure 5A:
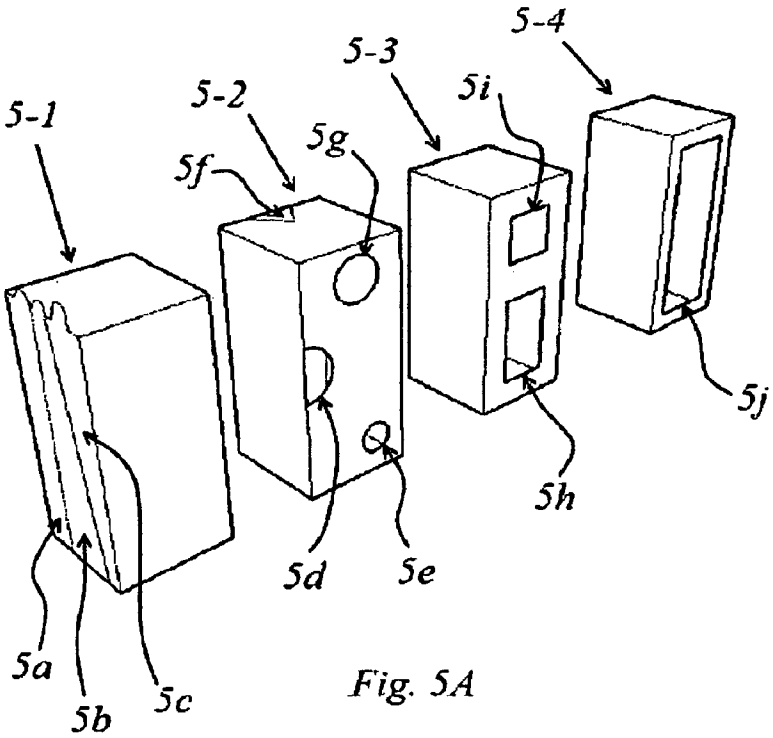

FIGS. 5A and 5B illustrate embodiments of the invention having an overall shape somewhat like a box of facial tissues. In box 5-4, the opening 5*j* can be similar to that of conventional facial tissues or a container for fasteners or the like, and the separable pieces of the seal member (not shown) can be oriented and positioned in any suitable direction and length (horizontal, vertical, angled, etc.) with respect to the container and opening, for purposes such as keeping the container relatively intact (e.g., top sealed) while having the convenience of a selected opening size. A plurality of openings 5*d*-5*j* is shown in the exemplary boxes 5-2 and 5-3. Box 5-1 shows how all or substantially all of an entire side of the box (the box's left side as viewed in FIG. 5A) can be selectively opened by removal of one or more seal portions 5*a*-*c*. Persons of ordinary skill in the art will understand that the embodiment illustrated as box 5-1 also shows how tabs can be provided, such as extending upwardly past the end of box 5-1 from each of the seal portions 5*a*-*c*. Such tabs can be positioned and shaped and sized (and even colored or numbered, etc.) based on intended use and/or other factors, and in addition to the variety shown in box 5-1, the strips 5*a*-*c* and/or any tabs associated therewith can be of uniform size, shape, and/or orientation.

Container 5-1 in FIGS. 5A and 5B illustrates how an entire side of such a container may be "sealed" with a plurality of removable elements such as strips 5*a*, 5*b*, and 5*c* (each shown as having a generally rounded tab extending away from the rest of the container body 5-1. Among other things, persons of ordinary skill in the art will understand that the tab(s) can be any convenient shape and size and thickness and material, including simply an extension of the material from which the seal itself is made. For embodiments such as container 5-1 in FIGS. 5A and 5B, the wide variety of materials that can usefully be employed includes cardboard such as is commonly used in tissue boxes, and the strips 5*a*, 5*b*, and 5*c* can simply be sections of that same material (cardboard) that forms the rest of the container 5-1, but which each may be selectively and separately removed from the container 5-1 to provide a desired corresponding opening and/or access into the container 5-1. Removing all three of the illustrated pieces 5*a*, 5*b*, and 5*c* would result in that entire side of the container 5-1 being "opened".

As indicated elsewhere, the invention has a wide variety of uses, and is not limited to sealing containers or passages. Among many other applications, the invention can be used in connection with games, such as those illustrated in FIGS. 6 and 7.

Figure 6C:
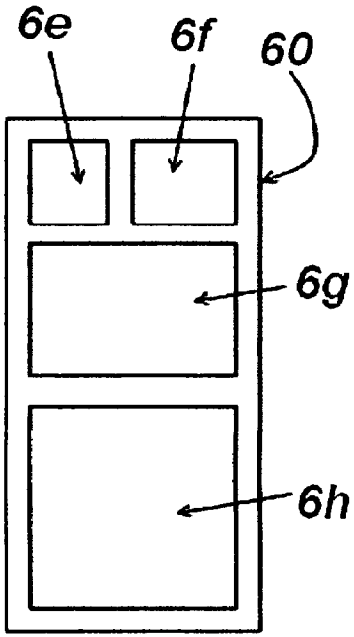
FIG. 6C is an elevation view of the board of FIG. 6A and/or 6B.
Figure 6D:
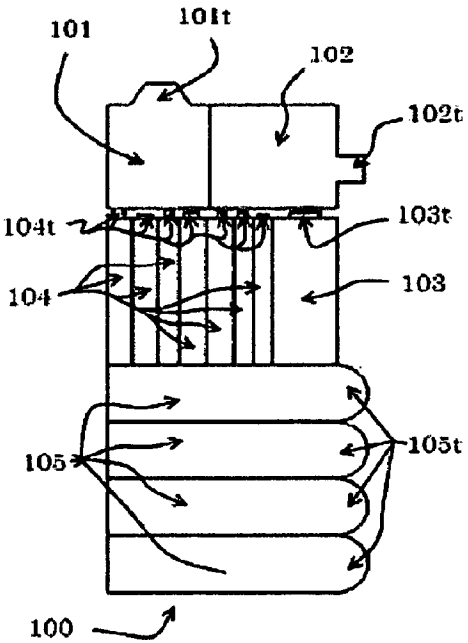
FIG. 6D is an elevation view of one of the many forms in which a plurality of seal elements can be shaped and sized to be affixed and/or otherwise associated with a board such as that of FIG. 6C.
Figure 6B:
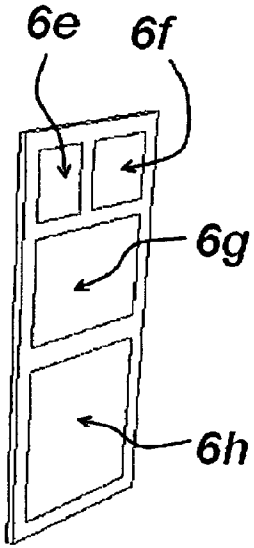
FIGS. 6A and 6B illustrate two of the many game boards that can incorporate the invention, with one or more data/information sections 6*a*-6*h* printed or otherwise provided on each.
Figure 6A:
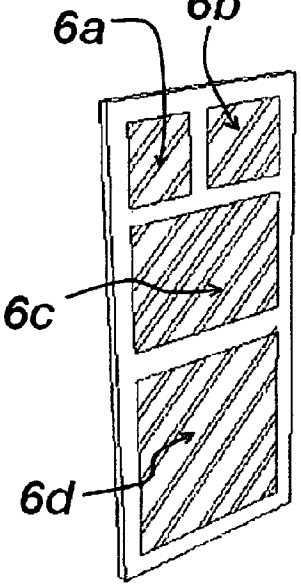

FIGS. 6A and 6B illustrate two of the many game boards that can incorporate the invention, with one or more data/information sections 6*a*, 6*b*, 6*c*, 6*d*, 6*e*, 6*f*, 6*g*, and/or 6*h* printed or otherwise provided on each. Persons of ordinary skill in the art will understand that the number, relative position, size, shape, and other characteristics of the information section(s) can be any of a wide variety, and that the particular data or other information likewise can be any of a wide variety. Among other things, they can be paintings, photographs, pictures, numbers, words, letters, colors, patterns, symbols, and/or other data relevant or tailored in some manner to the particular game or other contest or activity. The data and/or information can be placed on the board in any suitable manner (via printing, by the user, etc.) and, as shown in the example discussed below, in some manner covered by one or more embodiments of the seal of the invention. Persons of ordinary skill in the art will understand that FIGS. 6A and 6B show the indicia sections 6*a*-6*h* without any segmentable seal or seals covering them, a condition which might exist, for example, prior to affixing the seal(s) to the board and/or after removal of all portions of the seal(s).

FIG. 6D is an elevation view of one of the many forms in which a plurality of seal elements (collectively indicated as cover 100) can be shaped and sized to be affixed and/or otherwise associated with a board such as board 60 in FIG. 6C. Examples of the tab elements that may be included or used in a given cover embodiment are labeled with the letter "t" at the end of the associated seal portion number (thus, tab 101*t* preferably can be used to remove seal section 101, etc.). Although persons of ordinary skill in the art will understand that there does not need to be any particular correspondence between removable portions of the seal and the underlying area(s) such as 6*e*-6*h*, the embodiments illustrated in FIGS. 6C and 6D do include at least a general correspondence, such as indicated in the following table:

| Indicia/data area or section | Corresponding/covering seal section/portion(s) |
|---|---|
| 6e | 101 |
| 6f | 102 |
| 6g | 103 (one strip) and 104 (seven strips) |
| 6h | 105 (four strips) |

Figure 6H:
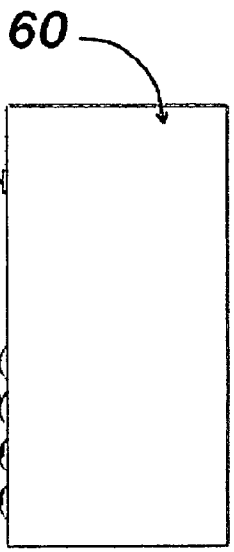
FIGS. 6G and 6H are elevation views taken from the back side of the embodiment shown in FIG. 6F, with and without the board, respectively.
Figure 6G:
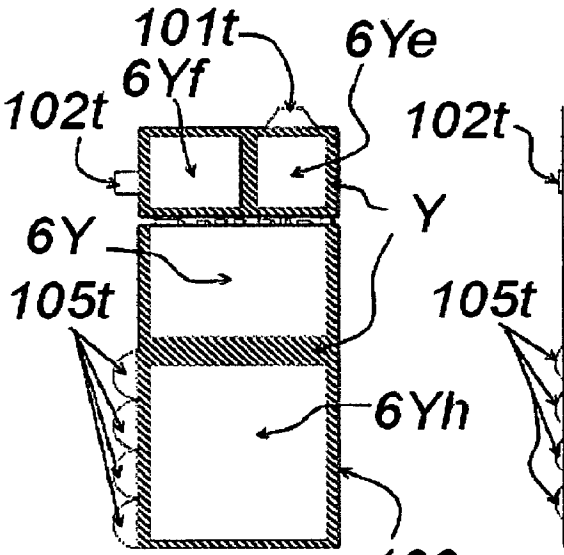
Figure 6E:
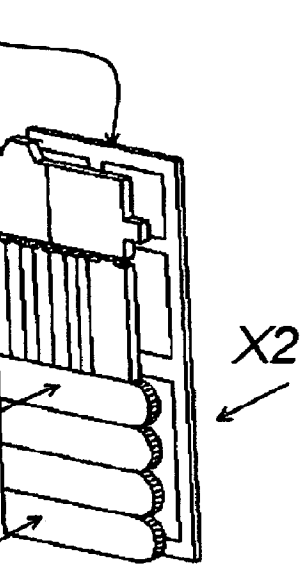
FIG. 6E illustrates a plurality of covers/seal(s) and/or seal section(s) about to be glued or otherwise affixed to the game board.
Figure 6F:
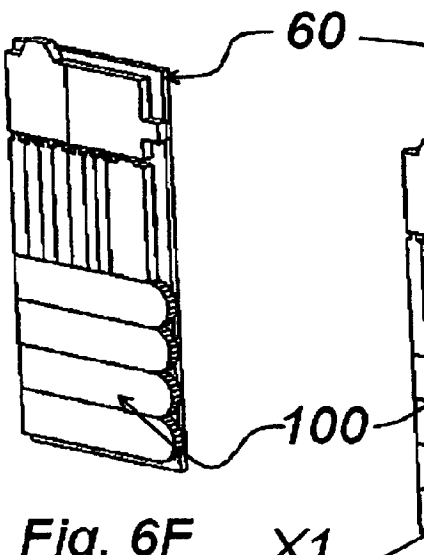
FIG. 6F shows the assembly after affixation.

FIG. 6E illustrates a plurality of covers/seal(s) and/or seal section(s) (such as might be provided in one or more sheets 100) about to be glued or otherwise affixed to the game board 60, and FIG. 6F shows the assembly after such affixation. Arrows X1 and X2 indicate the direction in which the elements 60 and 100 can be brought toward each other to result in the assembly of FIG. 6F.

FIG. 6H is an elevation view taken from the back side of the embodiment shown in FIG. 6F. Among other things, it illustrates the preferred protrusion of tabs 102*t* and 105*t* beyond the board 60, to facilitate gripping and removal by a user.

FIG. 6G is similar to FIG. 6H, but without the board 60. Persons of ordinary skill in the art will understand that the cover sheet(s) assembly 100 preferably has adhesive or similar means applied generally in the area indicated by cross-hatching Y, and/or the confronting areas of the board 60 are prepared with adhesive or other means for removably retaining the cover 100 in place over the indicia areas such as 6*e*-6*h*. Persons of ordinary skill in the art also will understand that the portions 6Ye-6Yh (that directly overly those corresponding indicia areas 6*e*-6*h*) may or may not have some form of adhesive (e.g., Sticky Notes® type temporary adhesive) on them.

Figure 7:
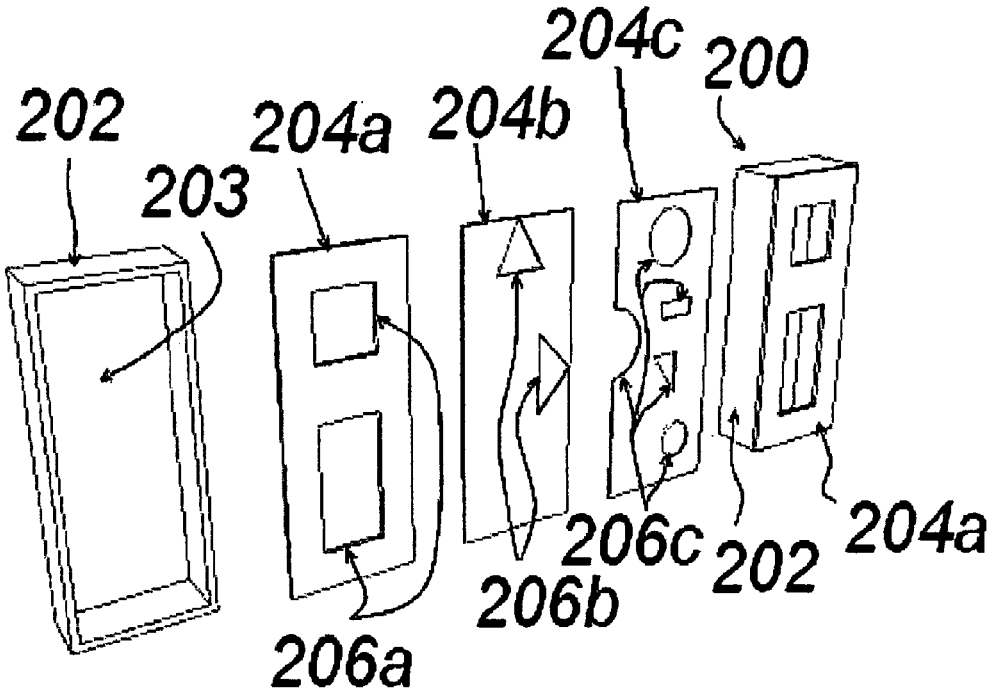
FIG. 7 illustrates another one of the many game boards that can incorporate the invention, with a playboard covering an interior portion of an open-sided box.

FIG. 7 illustrates another of the many types of games or other applications in which the invention can be used. An open-sided box 202 can define an interior 203 and be covered selectively by a playboard such as board 204*a-c*. The assembled example 200 at the far right of FIG. 7 combines the box 202 with the board 204*a*. Openings such as 206*a-c* can be positioned in the respective boards 204*a-c*, and those respective openings covered (not shown) by one or more multipart seals. Persons of ordinary skill in the art will understand that such seals preferably are affixed at least generally around the edges of the respective openings such as openings 206*a*, and may have tab elements to facilitate a user's removal of same from the assembly 200. At any given point in time, the openings 206*a* or any of them may be completely closed, partially open (such as when less than all of the seal has been removed by the user), or completely open (such as when the user has removed all of the seal over the respective opening).

The size and shape of all of the elements of assembly 200 can vary widely, depending among other things on the particular game in which the assembly is to be used. A game like Milton Bradley's® Operation® can be played, by positioning various items under each opening, and then placing the lid 204*a* onto the box 202. If the player is able to remove the item through the opening with less than all of the seal removed, the player may get a bonus score. In other games, small bean bags can be tossed at the assembly 200, and the player's score may be affected by how much of the seal has been removed from the opening 204*a* into which the bean bag falls. Young children may enjoy a game in which removing a portion of the seal reveals an opening shaped to correspond to one particular block or plastic piece, and the player has to find the right piece, orient it properly, and place it through the opening into the interior of the assembly 200. Preferably, boards 204*a-c* are removably affixed to the box 202, so that a variety of hole patterns 206*a-c* can be selected. Also preferably, replacement seal sheets are provided so that the game can be played repeatedly (a new sheet would be adhered to the board 204*a-c* prior to each game/use).

Figure 8:
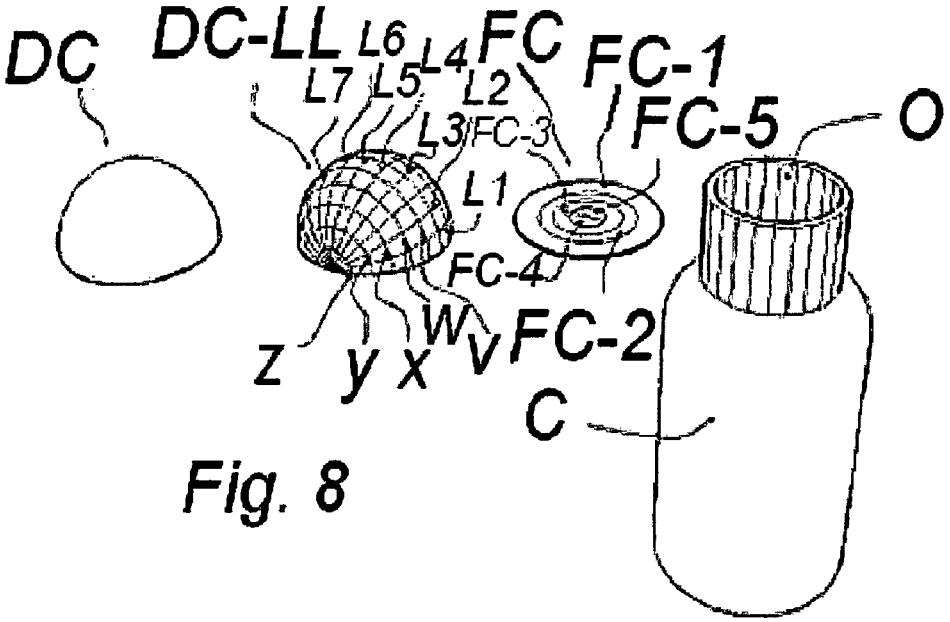
FIG. 8 illustrates a dome-shaped seal element in accordance with the present invention.

FIG. 8 illustrates a dome-shaped sealing element in accordance with an alternative embodiment of the present invention. In this embodiment, a container C with an opening O can be covered with a "bullseye" type multi-part seal/cover FC. Although the tearable portions such as FC-1, FC-2, etc. are shown as being generally concentric, other embodiments may have the tear lines in different relationships. In addition, although all of the tearable portions can be generally ring-shaped, the rings themselves can be multi-part (as with portions FC-4 and FC-5). Tabs can be provided, such as by multi-layering (not shown in this FIG. 8).

Another of the many embodiments of the invention is illustrated as a generally dome-shaped cover DC. Persons of ordinary skill in the art will understand that, in addition to the dome DC in FIG. 8, a wide variety of other 3-dimensional shapes can incorporate the invention. 3D seals in the general shape of baby-bottle nipples or other "bladder" shapes are some of the many examples.

Preferably, if the intended use or application benefits from the seal maintaining its general shape (such as a dome DC), the seal is fabricated from a tearable but somewhat rigid plastic or other material. Potential tearline patterns on such 3D shapes are virtually unlimited, and are illustrated in "lined" dome DC-LL. In that element, the dome DC is overlain with cross-hatching similar to the latitude and longitude lines on a globe. Latitude line z is close to the "polar region" in the drawing, with latitudes y, x, w, and v moving gradually toward the "equator." Longitudes L1 through L7 illustrate possible tearlines at right angles to the "latitude lines." Persons of ordinary skill in the art will understand that the tearlines for any given embodiment can be curved, angled, oriented differently than shown, and/or otherwise positioned within the dome DC in any useful and/or decorative pattern. Using the latitude/longitude system described above, a given embodiment of the invention may have any suitable "shape" tearable from the dome DC. For example, a "longitudinal" strip between L2 and L3 and extending from line y to line w can be formed as a single removable portion, with or with a tab or tabs. Among the many other patterns, a checkerboard pattern of tearable portions can be provided. Circles and/or other tearable shapes can be formed by selectively positioning the tearlines when designing and fabricating the seal DC.

Figure 9:
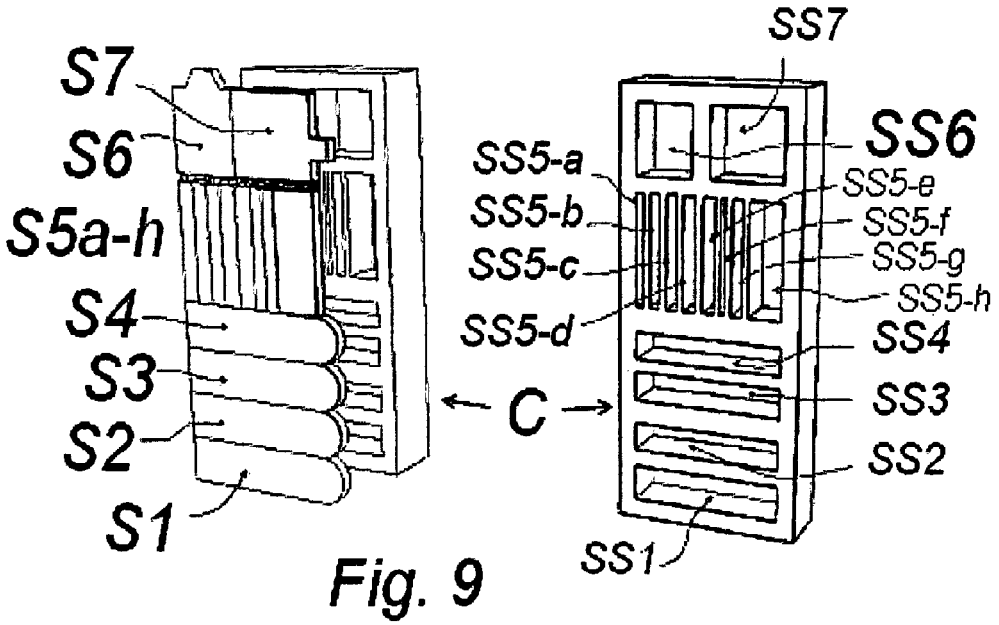
FIG. 9 illustrates yet another type of compartmentalized container with which the invention can be used.
Figure 9A:
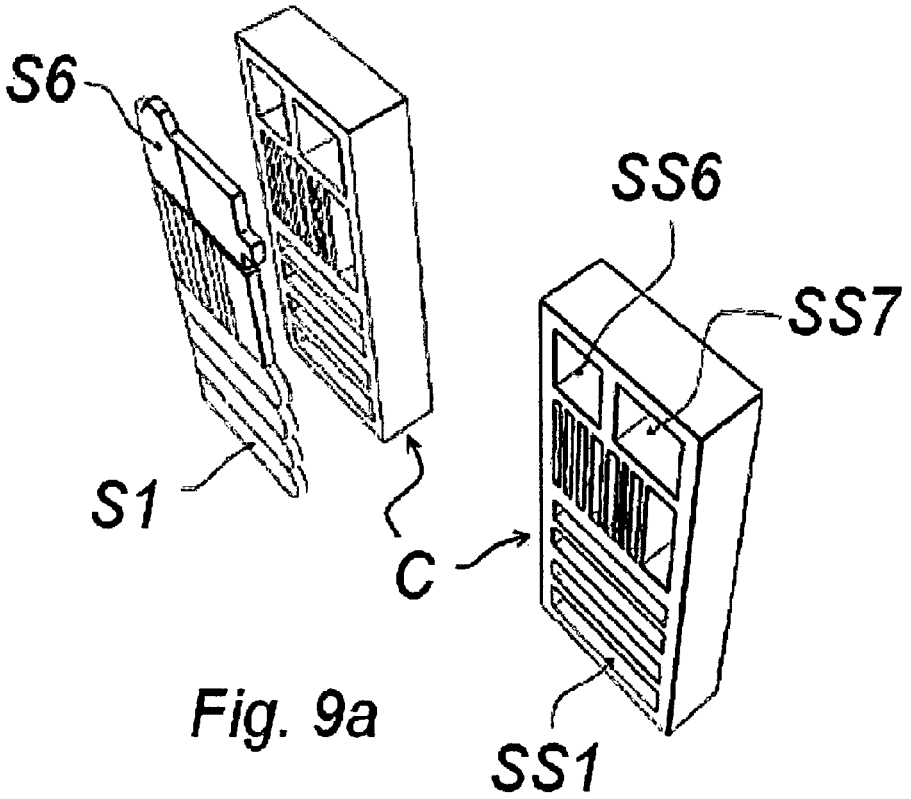
Figure 10D:
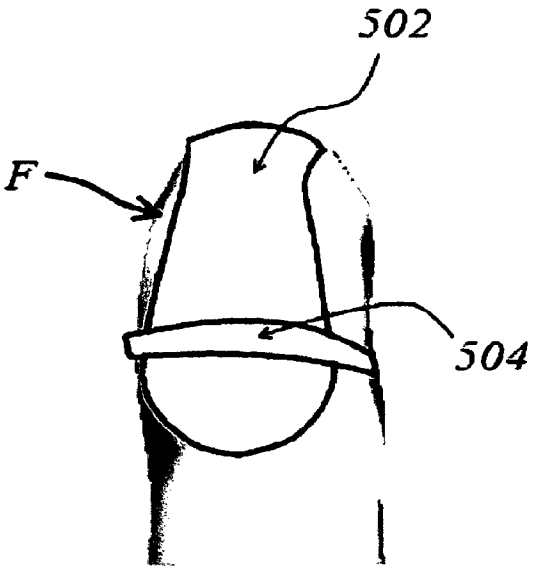
Figure 10C:
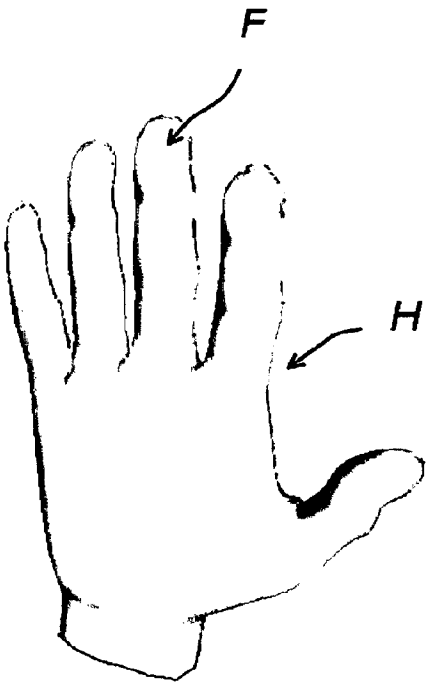
Figure 10C:
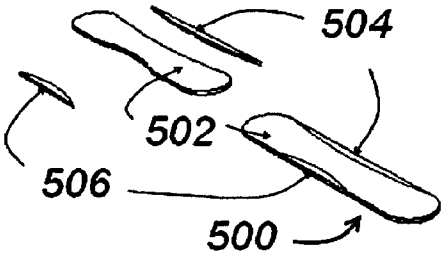

Yet another application of the invention is for packaging with multiple compartments. In FIG. 9, the container C can be generally box-like (as shown), or in any other suitable form and material. Among other things, the storage spaces SS1 through SS7 can be provided in a wide variety of shapes, sizes, depths, positions, and other design criteria. By way of further example, the "container" can be formed from plastic, even "soft" plastic, and the assembly process can include vacuum-sealing and/or heat-sealing the plastic snugly to the items stored within those storage spaces SS1 through SS7.

Any suitable cover element can be used, even one similar to that shown in other drawings. In FIG. 9, each tearable portion (S1 through S7) of the cover/seal preferably is correspondingly sized, shaped, etc. to cover the similarly-identified storage space (thus, when the seal assembly is affixed to the container C, portion S1 covers/seals storage space SS1, portion S2 covers/seals storage space SS2, and so on.

Among the many uses of such embodiments is packaging hardware parts for assemble-it-yourself furniture, first aid items, thread or other craft items, medication, paints, and many other things. In certain embodiments, information can be printed or otherwise located on and/or adjacent to the tearable portion, to identify the contents that are stored within that particular "pocket".

Yet another of the many applications of the invention is with a "kitting" box. A kitting box may be similar to box 202 shown in FIG. 7 having an interior portion, and having a cover embodiment comprised of a plurality of seal elements sized and shaped to be affixed and/or otherwise associated with the box. Persons of ordinary skill in the art will appreciate that those seal elements may be arranged in any desired configuration and combination of similar and/or different sized and shaped seal elements in order to provide a cover embodiment on the kitting box. Further, persons of ordinary skill will appreciate that those removable seal elements may correspond to underlying compartments, or a single seal element may correspond to more than one or all of the underlying compartments of the kitting box. As described in connection with other embodiments, those seal elements may have corresponding tab elements at their end portions to facilitate removal of their associated seal portion.

In FIGS. 10A-10D, yet another embodiment of the invention is illustrated. An adhesive bandage 500 can "seal" a wound on a finger F, on a hand H, or at least position a protective pad 508 over the wound. Removable portions such as 504 and 506 preferably have adhesive on them (preferably fabricated as part of the same layer or coating of adhesive that is present on the main body 502 of the bandage). A user can selectively remove one or more such portions 504 and/or 506, and can use that portion to help hold the body 502 more securely in place over the wound (such as in FIG. 10D), or can use it for some other possibly even unrelated purpose.

Methods of fabricating and assembling various embodiments can include preparing the various sheets/covers in a mass production manner, using computer controls to position the desired cuts and tearlines for the given embodiment, applying the adhesive or other means to removably adhere the cover in its desired position with the desired degree of security, and related steps. Methods of use can include those described above (such as pouring, sealing, playing, etc.), and many others.

For the purpose of summarizing the invention, certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The apparatus and methods of the invention have been described with some particularity, but the specific designs, constructions, and steps disclosed are not to be taken as delimiting of the invention. A wide range of modifications and alternative structures and steps for practicing the invention will make themselves apparent to those of ordinary skill in the art, all of which will not depart from the essence of the invention, and all such changes and modifications are intended to be encompassed within the appended claims.

What is claimed is:

1. Apparatus for sealing an opening to a compartment, including:

an opening to a compartment defined by at least one edge;

a seal layer sized and configured to cover said opening, said seal layer effectively adhered to at least substantially all of the edge of said opening, said seal layer having a plurality of tear lines defining a plurality of portions of the seal layer positioned over the opening of the compartment, the tear lines positioned and formed for selective tearing to permit selective removal of at least two of the plurality of portions of the seal layer from the opening by pulling on a gripping tab portion connected to at least one of the plurality of portions of the seal layer to remove a related portion of the seal layer, and at least one additional layer of material provided in a generally parallel and confronting relationship with the seal layer over substantially most of the opening, said additional material configured to separate along a line in a location of the additional material that does not have a tear line, said line at least generally corresponding to one of the plurality of tear lines of the seal layer when said one of the plurality of tear lines is selectively torn.

2. The apparatus of claim 1, in which one tear line of the plurality of tear lines defines at least two portions of the first seal layer, further including at least one tab connected to each portion of the first seal layer, said tabs respectively providing a gripping portion by which a user may remove at least the portion of the first seal layer associated with that tab.

3. A method of temporarily sealing and unsealing an opening, including the steps of:

providing a seal on an opening, said seal having the characteristics of claim 1;

selecting at least a portion of the seal for removal; and removing that portion.

4. A method of temporarily sealing and unsealing an opening, including the steps of:

providing a seal on an opening, said seal having the characteristics of claim 1;

selecting at least one tab associated with a portion of the seal; and pulling that tab and thereby removing that portion.

* * * * *